US005301608A

United States Patent [19]

Szarka et al.

[11] Patent Number: 5,301,608

[45] Date of Patent: Apr. 12, 1994

[54] INDEX CONTROL SYSTEM FOR PRINTING APPARATUS

[75] Inventors: Sandor Szarka; David Jaffa, both of Franklin Lks., N.J.

[73] Assignee: Precision Screen Machines, Inc., Hawthorne, N.J.

[21] Appl. No.: 72,467

[22] Filed: Jun. 4, 1993

[51] Int. Cl.[5] ..... B41M 1/12

[52] U.S. Cl. ..... 101/129; 101/126; 101/485; 101/232

[58] Field of Search ..... 101/477, 485, 492, 493, 101/228, 253, 257, 268, 279, 232, 212, 218, 115, 118, 121, 122, 126, 129

[56] References Cited

U.S. PATENT DOCUMENTS

| | | | |
|---|---|---|---|
| 3,903,792 | 9/1975 | Vertegaal | 101/118 |
| 3,949,864 | 4/1976 | Montsant | 101/126 |
| 4,173,928 | 11/1979 | Mitter | 101/126 |
| 4,492,163 | 1/1985 | Ericcson | 101/126 |
| 4,589,335 | 5/1986 | Svantesson | 101/126 |
| 5,245,922 | 9/1993 | Klemm | 101/126 |

*Primary Examiner*—Eugene H. Eickholt
*Attorney, Agent, or Firm*—Hopood, Calimafde, Kalil, Blaustein & Judlowe

[57] ABSTRACT

This invention relates to an apparatus and method for controlled indexing of an article to a printing station. In accordance with one aspect of the invention, the apparatus comprises an endless printing blanket carried by rollers positioned within the blanket and a translatable carriage assembly operatively associated with the blanket. The assembly includes an expandable clamping member which, upon selected expansion, contacts the blanket to secure the assembly thereto. The assembly follows the blanket as it (and the article it supports) are indexed to the printing station. An encoder monitors the distance traveled by the blanket during indexing and corrects for variation between the distance traveled and a preset distance. Upon arrival of the article at the printing station, the clamping member contracts, concomitantly releasing the blanket. A cylinder then returns the assembly a selected distance in position for another indexing movement, and so forth.

11 Claims, 3 Drawing Sheets

INDEX CONTROL SYSTEM FOR PRINTING APPARATUS

BACKGROUND OF THE INVENTION

The present invention relates to printing apparatus, and more particularly to an improved apparatus and method which facilitates production of quality images upon repetitive printing operations.

The printing of multicolored and other complex images on articles (such as sheets of textiles, plastic or the like) is commonly accomplished by screen printing machines. Generally, these machines are provided with a conveyorized printing blanket driven over a pair of spaced apart rotating drums. The article is placed flat on the blanket and indexed to each in a series of printing stations. At each station, a printing head is lowered onto the article and a printing operation is performed. For example, a print squeegee is stroked across the surface of a horizontal screen in registry with the article so as to force printing ink through the screen and onto the article, thereby effecting printing. In this manner, each in a series of printing steps are performed on the article to obtain a desired complex image.

To assure quality, it has been found desirable that the printing head be in precise registration with the article. However, manufacturing imperfections inherent in printing blankets, i.e., the nonuniform center or neutral plane within, have been found to inhibit precise registration. In particular, upon each indexing movement of the blanket (and associated angular displacement of the drums), the distance traveled by the blanket circumference (over the drums) varied with the neutral plane of the blanket. While these variations were small initially, they compounded upon repeated printing operations, visibly offsetting the blanket from a desired position relative to the printing head. This resulted not only in overlapping images and other printing inaccuracies, but also complicated set up by requiring numerous adjustments to obtain acceptable, though seldom precise, registration.

SUMMARY OF THE INVENTION

In accordance with one aspect of the present invention, there is provided an apparatus and method for controlled indexing of an article to a printing station. The apparatus comprises an endless printing blanket carried by rollers positioned within the blanket and a translatable carriage assembly operatively associated with the blanket. The assembly includes an expandable clamping member which, upon selected expansion, contacts the blanket so as to secure the assembly thereto. The assembly follows the blanket as it (and the article it supports) are indexed to the printing station. An encoder monitors the distance traveled by the blanket during indexing and corrects for selected variation between the distance traveled and a present distance. Upon arrival of the article at the printing station, the clamping member contracts, concomitantly releasing the blanket. A cylinder then returns the assembly a selected distance in position for another indexing movement, and so forth.

The present invention is directed to an apparatus for controlling movement of a printing blanket, which comprises:

a translatable carriage assembly operatively associated with the blanket, the assembly having an expandable clamping member which, upon selected expansion, contacts the blanket to secure the assembly thereto;

an encoder for monitoring movement of the assembly as it is indexed with the blanket and for correcting selected variation between the distance traveled by the blanket during indexing and a preset distance; and a cylinder for returning the assembly a selected distance upon contraction of the clamping member and its concomitant release of the blanket.

The present invention is further directed to a method for controlling movement of a printing blanket, which comprises the steps of:

clamping a translatable carriage assembly to the blanket, said clamping being effected by an expandable member which, upon selected expansion, contacts the blanket to secure the assembly thereto;

indexing a blanket supported article to a printing station while an encoder monitors forward motion of the blanket and corrects for selected variation between the distance traveled by the blanket during indexing and a preset distance;

contracting the clamping member such that it concomitantly releases the blanket; and returning the assembly a selected distance in position for another indexing movement.

Accordingly, it is an object of the present invention to provide an apparatus which both increases production and improves the quality of printed images upon each of successive printing operations.

Another object of the present invention is to maintain each blanket supported article at a selected location relative to a printing station upon successive printing operations.

Still another object of the present invention is to provide an apparatus which effects precise registration of a printing head with an article.

A further object of the present invention is to provide an apparatus which monitors movement of a printing blanket and compensates for selected variation in the distance it travels upon each indexing movement.

The present invention will now be further described by reference to the following drawings which are not to be deemed limitative in any manner thereof.

BRIEF DESCRIPTION OF THE DRAWINGS

The same numerals are used throughout the various figures of the drawings to designate similar parts.

Figure 1:
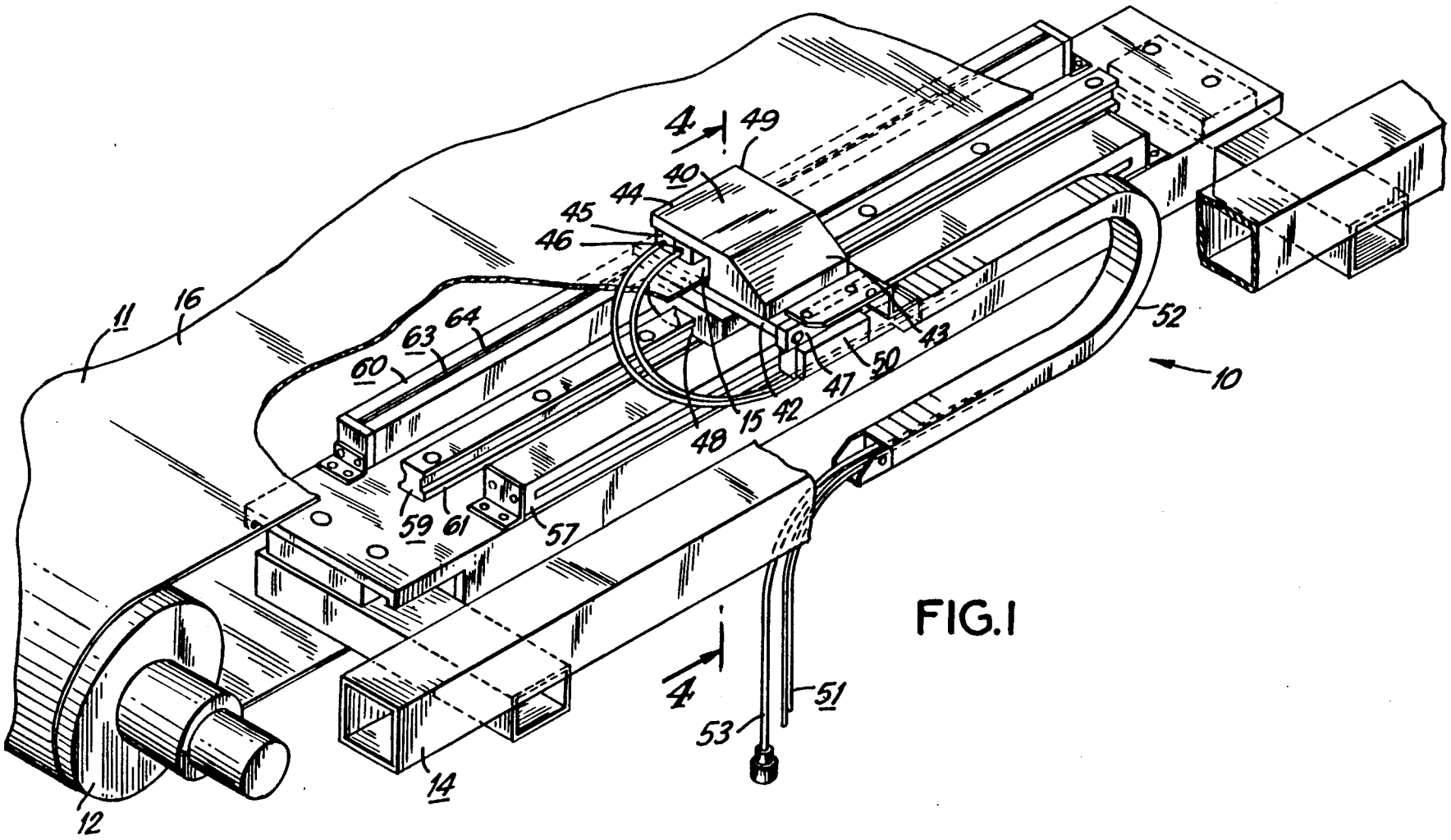
FIG. 1 is a perspective view of an apparatus embodying the present invention.
Figure 2:
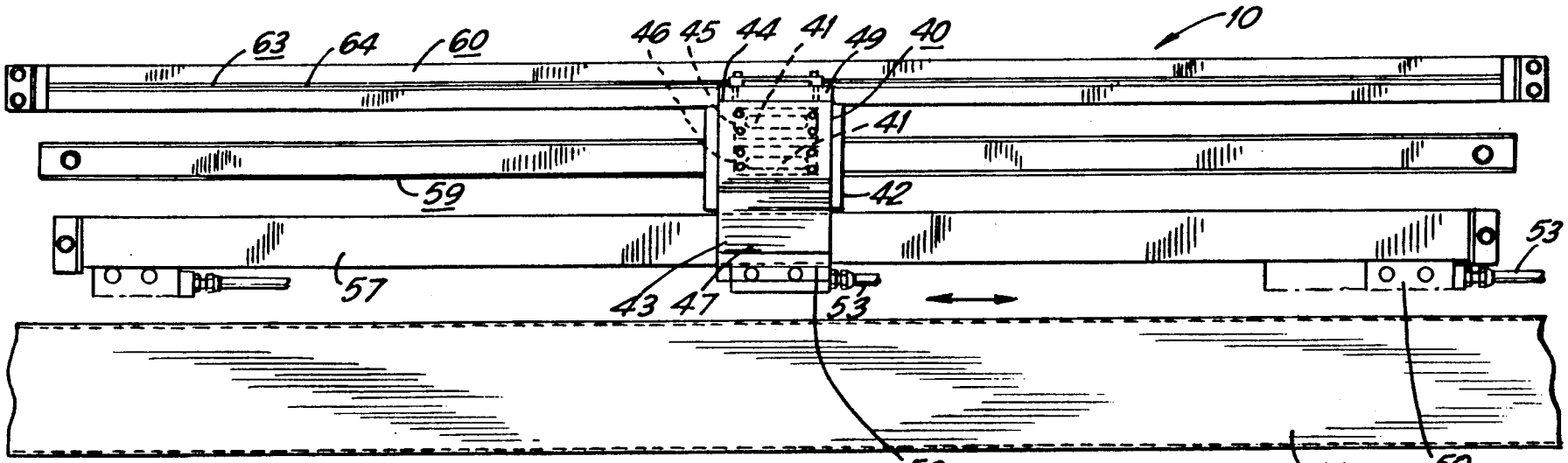
FIG. 2 is a plan view of the apparatus of FIG. 1 without the printing blanket, illustrating an operating sequence of the present invention.
Figure 3:
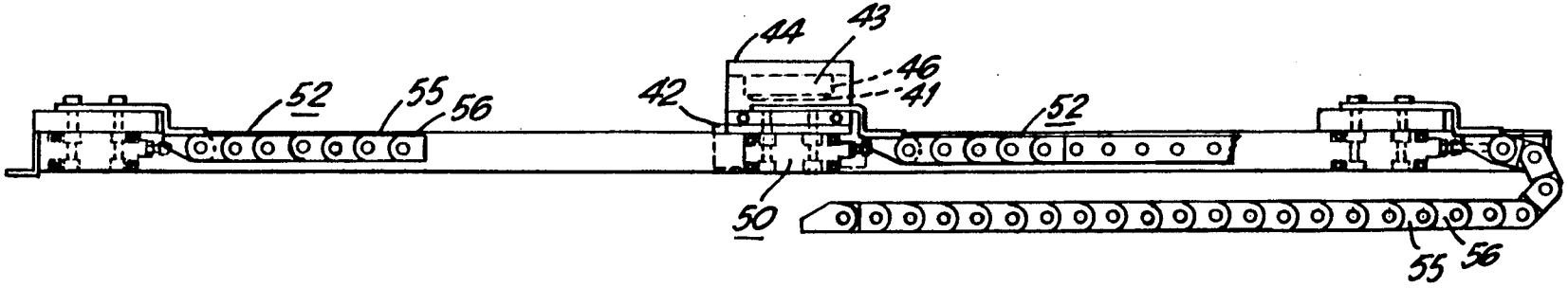
FIG. 3 is a side view of the apparatus of FIG. 2.

Still other objects and advantages of the present invention will become apparent from the following description of the preferred embodiments.

DETAILED DESCRIPTION OF THE PREFERRED EMBODIMENTS

FIGS. 1–6 illustrate an apparatus 10 for controlled indexing of an article 20, e.g., a cloth panel or plastic sheet, to a printing station 30. The apparatus includes an endless printing blanket 11 carried by rollers 12, 13 positioned within the blanket and a translatable carriage assembly 40 operatively associated with the blanket. The assembly includes a pair of expandable clamping members 41 which, upon selected expansion, contact the blanket to secure the assembly thereto. This allows the assembly to follow the blanket as it is indexed. An encoder 50 monitors the distance traveled by the blanket during indexing and corrects for selected variation between the distance traveled by the blanket and a preset distance. Upon completion of the indexing movement, the clamping member contracts, concomitantly releasing the blanket. A cylinder 60 then returns the assembly a selected distance in position for another indexing movement.

Rollers 12, 13 are preferably drums of a selected diameter, e.g., 10 to 12½ inches. The drums are spaced apart horizontally and rotatably mounted at opposing ends of a table-like support structure 14. Blanket 11 (e.g., 30–150 feet long) fits snugly over and extends between the drums such that it is maintained in a relatively flat horizontal plane.

To insure that articles to be printed upon remain at selected locations on the blanket and to minimize blanket slippage over the drums, the blanket is preferably constructed of a relatively strong, rigid material having a nonslip type surface, e.g., an adhesive coated blanket upper surface. It is also preferred that the blanket be of uniform thickness and have a smooth, distortion free surface which facilitates relatively precise registration between the printing head and article. Resistance of the blanket to chemicals typically used during printing is also desireable.

Suitable blanket materials include, for example, Kevlar, fiberglass, a polyester reinforced elastomer or a polyurethane coated polyester product. Such materials are formed into thread and woven in layers to form the blanket. The thread thickness and the number of strands per width inch affect the tolerance of the blanket, i.e., uniformity of the neutral plane—a plane which runs generally lengthwise along the geometric center of the blanket cross section, and the accuracy of printing.

Although the aforementioned features are relatively important for providing optimum printing operations, it is understood by those skilled in the art that other characteristics may be significant. For example, the location of the neutral plane is a factor to be considered in the design of the present invention. Another factor is reduction in blanket thickness which occurs as the blanket passes over the drums, such reduction being proportional to blanket tautness.

The translatable carriage assembly comprises a relatively flat base 42, a housing 43 positioned generally midway along the base, and an arm 44 cantilevered from the housing. A portion of the base extends beneath the arm such that the assembly takes a U-like shape. The assembly is positioned in a sideways orientation over one edge 15 of the blanket, the arm extending over and the base underneath the blanket.

A pair of relatively parallel members 45, 46 extend vertically downward from the arm. Each member mounts an expandable clamping member 41 disposed generally face-to-face with blanket surface 16. Upon selected expansion of the members, e.g., pneumatically, they press against the blanket surface sufficiently to secure the assembly to the blanket. This allows the assembly to move simultaneously with (or be carried by) the blanket as it moves an article to each printing station.

Forward motion of the blanket, in particular, the distance traveled upon each indexing movement, is monitored by encoder 50 at outbound end 47 of the assembly. The encoder is equipped, for example, with an electronic eye disposed face-to-face with a reader bar 57 which spans the range of assembly movement. As the assembly is carried by the blanket, the encoder records the distance traveled. The encoder monitors forward movement of the blanket, determines the distance traveled, and computes the difference between the distance traveled and a preset distance to be indexed by the blanket. The maximum deviation from the preset (or desired) distance is preferably maintained within a range of ±one pulse or 0.0005 inches.

The encoder is calibrated to click off one pulse for each selected incremental distance traveled by the blanket upon its forward movement, e.g., 0.0005 inch. Once a number of pulses is reached which corresponds with the preset distance, the encoder computer signals a servomotor to stop the blanket. If the indexing movement of the blanket is complete but the distance traveled is less than the preset distance by more than one pulse, the blanket is moved another pulse. This insures that the distance traveled by the blanket during each indexing movement will remain relatively constant within the range of maximum deviation from the preset distance.

Alternatively, deviation from the preset distance is corrected during the next indexing movement. Specifically, if, after indexing, the maximum deviation is either above or below one pulse, the next distance to be indexed may be adjusted to compensate. The difference between the distance traveled and the preset distance is signaled by the encoder to the servomotor which causes the drums to rotate during the next indexing movement a distance greater or less than the preset distance. For example, if the blanket has traveled a distance greater than the preset distance, the next indexing movement (angular displacement of the drum) will be proportionately less than the preset distance. Should the blanket travel a distance less than the preset distance, the next indexing movement will be proportionately greater. This insures that the printing head will print successive images on an article within an acceptable range of error, preferably that which would pass undetected by the human eye.

After each indexing movement, the clamping members contract, e.g., by deflation, sufficient to concomitantly release the blanket. Cylinder 60 is then actuated for return of the assembly (and encoder) a selected distance in position for the next printing operation, and so forth. It is noted that deflation of the clamping members may be performed before or after the printing operation. Alternatively, deflation may occur before or after the encoder has determined whether, or to what extent, the next indexing movement of the blanket is to be adjusted.

Cylinders of a pneumatically actuable type have been found suitable for this purpose. Such a cylinder, for example, comprises a relatively long, cylindrical tube adapted for receiving a piston, the tube interior having a pneumatic chamber. As the chamber pressure is increased at one end of the tube, i.e., via an air-fill tube, the piston (operatively mounted to the assembly) is forced along the chamber, thereby effecting translation of the assembly. As the chamber pressure increases at the opposite end of the tube, the piston (and assembly) are pushed along the chamber in the opposite direction, causing the assembly's eventual return the selected distance for another indexing movement. An operating sequence is completed upon its return.

More particularly, return of the assembly is effected by zip lock 63 in the cylinder upper surface. The zip lock comprises an opening 64 which spans the cylinder, end to end, and a tab 65 which moves freely along and protrudes from the opening. Upon return of the cylinder, the tab engages and pulls the assembly along the selected distance for another indexing movement.

Ball rail track 59 is mounted along the length of support structure 14 to facilitate linear translation of the assembly along the blanket. The assembly is mounted at its base to rail 61, the base having a rail receiving section 48 configured for sliding reception of the rail. Sliding reception is facilitated by bearings 62 positioned at points of contact between the rail receiving section and the rail.

The assembly is oriented horizontally across the track, the encoder being adjacent to the assembly's outbound end 47. Inbound end 49 of the assembly, in turn, is in proximity to the cylinder. The track insures that the assembly is readily pulled along with the blanket and remains relatively level for precise monitoring and measurement of blanket movements, e.g., in a forward direction.

It has been found that inaccuracies in the assembly's return and clamping of the blanket are relatively less important to precise registration. Accordingly, the blanket starting position, or the selected distance of the assembly's return, may vary upon each indexing movement; provided, however, that each indexing movement is maintained the same to a high degree of accuracy.

A pair of fluid supply lines 51, e.g., pneumatic air-fill tubes, are linked preferably to a high pressure source, e.g., a compressor, for controlling fluid flow to and from expandable members 41. The supply lines are housed in a relatively continuous, hollow chain or centipede-like structure 52. As the assembly moves to and fro, the structure follows, flexing at its multiple link sections 55, 56.

The present invention optimizes positioning of blanket supported articles beneath each in a succession of printing heads during repetitive printing operations. More particularly, the assembly compensates for offsetting of the blanket as it passes over the drums which may affect precise registration. Offsetting may result from a variety of factors including variation in the neutral plane along the circumference of the printing blanket, i.e., those due to the composition, internal construction and other inherent defects in the printing blanket. Other factors include variation in drum diameter due to temperature changes, e.g., between morning and afternoon operation.

As a result, images are accurately printed upon repeated printing operations. Operation of the present invention has been found well within a suitable range of nonvisible error in the printed design, e.g., less than or equal to 0.003 inches.

Figures 4, 5, 6:
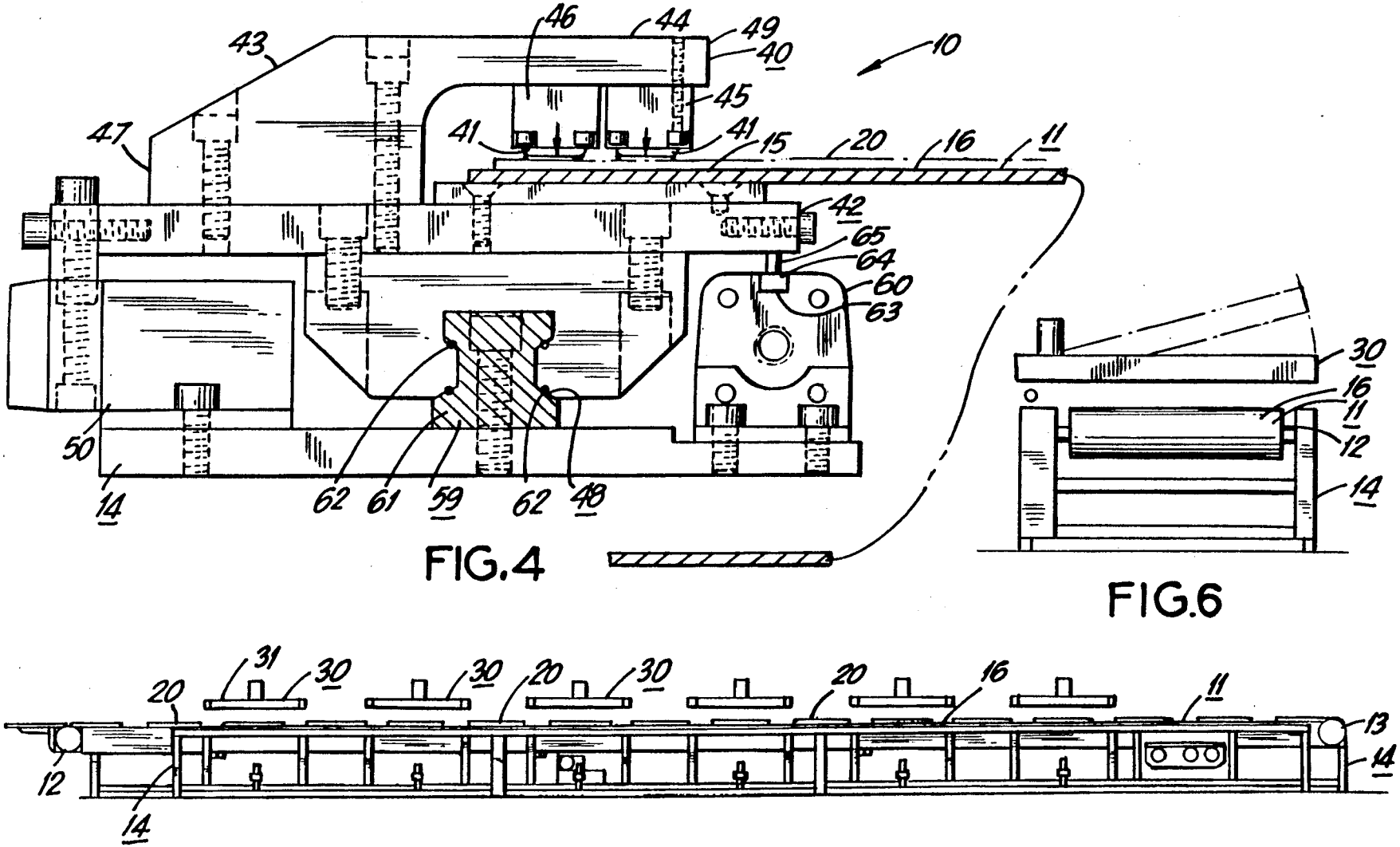
FIG. 4 is a sectional view of FIG. 1 taken along line 4—4 of FIG. 1.
FIG. 5 is a side view of a printing apparatus in accordance with one aspect of the present invention.
FIG. 6 is a front view of a printing station of FIG. 5.

As shown in FIG. 5, the blanket typically operates in conjunction with a plurality of printing stations 30, each for printing a selected pattern and/or color to achieve a desired composite (e.g., multicolored) image. The printing blanket (and article) is indexed once for each printing station on the printing apparatus. For example, where eight printing stations are used from start to finish, each article is indexed eight times.

In operation, the article is placed flat upon the printing blanket surface. The clamping members are inflated with a fluid such as air to a degree suitable for pressing the member against the blanket surface and securing the assembly thereto. The blanket (and article) are then indexed to a selected location beneath a first printing station 31 where a printing operation is performed on the article. As the blanket moves, it carries the assembly, the encoder monitoring and recording the distance traveled by the blanket and correcting for selected variation between the distance traveled and the preset distance.

After the indexing movement has been completed, the assembly's clamping members contract sufficiently to concomitantly release the blanket. Cylinder 60 is then actuated for return of the assembly (and encoder) to a selected starting position for the next printing operation.

Alternatively, the distance to be traveled upon the next indexing movement is adjusted for variations between the distance traveled by the blanket during the prior indexing movement and the preset distance. Whether, or to what extent, the next indexing movement is to be adjusted is determined preferably, along with the signaling of the adjusted distance to the servomotor, upon cessation of the indexing movement. This provides optimal speed of operation, though it is understood by those skilled in the art that such may be done at other suitable times prior to the next indexing movement.

As the article is indexed to the next printing station, where another printing operation is performed, e.g., in a different color, the assembly is carried by the blanket. Indexing movements of the blanket are actuated by a time delay switch or the like.

The present invention advantageously monitors and compensates for shifting of the printing blanket upon each indexing movement over the drums. By controlling the distance traveled upon each indexing movement, offsetting of the blanket supported article from the printing head is minimized.

The embodiments illustrated above involve application of the present invention to multistep printing operations typically used in screen printing composite or multicolored images on articles. A part and/or color of the image is printed upon each step. However, its application to any printing system, apparatus and/or method is understood, giving consideration to the purpose for which the present invention is intended.

Moreover, while the present invention is shown and described for use in conjunction with sheets of textiles or plastic, its application to other articles such as T-shirts, towels, placemats, pot holders, curtains and sheets will be understood by those skilled in the art, giving consideration to the purpose for which the present invention is intended.

Since from the foregoing the construction and advantages of the invention may be readily understood, further explanation is believed unnecessary. However, since numerous modifications will readily occur to those skilled in the art after consideration of the foregoing specification and accompanying drawings, it is not intended that the invention be limited to the exact construction shown and described, but all suitable modifications and equivalents may be resorted to which fall within the scope of the appended claims.

What is claimed is:

1. An apparatus for controlling movement of a printing blanket, the apparatus including:

a translatable carriage assembly operatively associated with the blanket, the assembly having an expandable clamping member which, upon selected expansion, contacts the blanket to secure the assembly thereto;

an encoder for monitoring movement of the assembly as it is indexed with the blanket and for correcting selected variation between the distance traveled by the blanket during indexing and a preset distance; and a cylinder for returning the assembly a selected distance upon contraction of the clamping member and its concomitant release of the blanket.

2. An apparatus as set forth in claim 1 wherein the assembly is supported by at least one rail upon its movement with the blanket and return.

3. An apparatus as set forth in claim 1 wherein the assembly has two clamping members.

4. An apparatus as set forth in claim 1 wherein the blanket has a relatively rigid, slip proof surface.

5. An apparatus as set forth in claim 1 wherein the blanket comprises a chemically resistant material.

6. An apparatus for controlled indexing of an article to a printing station, the apparatus including:

an endless printing blanket carried by rollers positioned within the blanket;

a translatable carriage assembly operatively associated with the blanket, the assembly having an expandable clamping member which, upon selected expansion, contacts the blanket to secure the assembly thereto;

an encoder for monitoring movement of the assembly as it is indexed with the blanket and for correcting selected variation between the distance traveled by the blanket during indexing and a preset distance; and a cylinder for returning the assembly a selected distance upon contraction of the clamping member and its concomitant release of the blanket.

7. A method for controlling movement of a printing blanket, which comprises the steps of:

(a) clamping a translatable carriage assembly to the blanket, said clamping being effected by an expandable member which, upon selected expansion, contacts the blanket to secure the assembly thereto;

(b) indexing a blanket supported article to a printing station while an encoder monitors forward motion of the blanket and corrects for selected variation between the distance traveled by the blanket during indexing and a preset distance;

(c) contraction of the clamping member such that it concomitantly releases the blanket; and (d) returning the assembly a selected distance in position for another indexing movement.

8. The method set forth in claim 7 wherein step b includes the step of comparing the distance traveled by the blanket to a preset distance.

9. The method set forth in claim 8 wherein step b further includes the step of determining whether the distance traveled is within a predetermined range of error from the preset distance and, if not, computing the distance to be traveled by the blanket upon a subsequent indexing movement.

10. A method for controlling movement of a printing blanket, which comprises the steps of:

(a) clamping a translatable carriage assembly to the blanket, said clamping being effected by an expandable member which, upon selected expansion, contacts the blanket to secure the assembly thereto;

(b) indexing a blanket supported article to a printing station while an encoder monitors its forward motion;

(c) comparing the distance traveled by the blanket to a preset distance, determining whether the distance traveled is within a predetermined range of error from the preset distance, and, if not, computing the distance to be traveled by the blanket upon a subsequent indexing movement;

(d) contraction of the clamping member such that it concomitantly releases the blanket; and (e) returning the assembly a selected distance in position for another indexing movement, the encoder adjusting the distance traveled by the blanket upon a subsequent indexing movement for variations between the distance traveled during the prior indexing movement and the preset distance.

11. The method set forth in claim 10 wherein step d is prior to step c.

* * * * *